US006053156A

United States Patent [19]

Boon

[11] Patent Number: 6,053,156

[45] **Date of Patent: *Apr. 25, 2000**

[54] LINE PLACING APPARATUS AND METHOD

[76] Inventor: Johan Hendrik Boon, 8501 Lochinvar Dr., Charlotte, N.C. 28227

[ * ] Notice: This patent issued on a continued prosecution application filed under 37 CFR 1.53(d), and is subject to the twenty year patent term provisions of 35 U.S.C. 154(a)(2).

[21] Appl. No.: 08/796,053

[22] Filed: Feb. 7, 1997

[51] Int. Cl.[7] ..... F41B 7/00

[52] U.S. Cl. ..... 124/20.1; 242/323; 242/1.1; 24/129; 24/128

[58] Field of Search ..... 24/116 A, 128, 24/129; 43/43.19, 43.2; 242/323; 254/134.3; 294/1.1, 19.1, 82.11; 124/20.1

[56] References Cited

U.S. PATENT DOCUMENTS

| | | | |
|---|---|---|---|
| 2,184,187 | 12/1939 | Hildebrandt . | |
| 2,241,367 | 5/1941 | Sarff | 43/38 |
| 3,453,769 | 7/1969 | Chandler . | |
| 3,683,882 | 8/1972 | Braxton | 124/20 B |
| 3,774,953 | 11/1973 | Babcock | 294/19 R |
| 4,127,956 | 12/1978 | Hertkorn . | |
| 4,140,412 | 2/1979 | Vitt | 403/28 |
| 4,205,733 | 6/1980 | Wade | 182/142 |
| 4,587,943 | 5/1986 | Ross | 124/20 R |
| 4,845,879 | 7/1989 | Urso | 43/18.1 |
| 5,363,584 | 11/1994 | Lo | 43/19 |
| 5,493,807 | 2/1996 | Sullins | 43/19 |
| 5,661,922 | 9/1997 | Bonomo | 43/42.31 |

FOREIGN PATENT DOCUMENTS

| | | | |
|---|---|---|---|
| 1034-758 | 7/1978 | Canada | 43/46 |

OTHER PUBLICATIONS

The "Big Shot Pole Mounted Sling Shot" brochure, W.T. Sherrill, Inc., Greensboro, Tennessee.

*Primary Examiner*—S. Thomas Hughes
*Assistant Examiner*—Steven A Blount
*Attorney, Agent, or Firm*—Kennedy, Davis & Hodge, LLP

[57] ABSTRACT

A device for placing a work line into a space that is normally difficult-to-reach, comprising a tubular handle having a locally terminated distal end and a hand-gripped slingshot attached to a butt end of the handle. A spool of a pull line attaches to the handle. The spool is selectively operated for freely releasing the pull line from the spool and for rewinding the pull line onto the spool for pulling a work line into a remote space which is difficult to reach. A weight attached to the free end of the pull line is fired by the slingshot into the difficult-to-reach space to move the pull line thereinto. A work line is secured to the pull line and pulled into the difficult-to-reach space. Embodiments of a traveller for connecting the pull line to the work line and for guiding the engagement of the pull line and the work line upwardly into and through an upper portion of a tree. A method of placing a work line into an upper portion of a tree for use by tree climbers in performing tree maintenance services is disclosed.

6 Claims, 3 Drawing Sheets

LINE PLACING APPARATUS AND METHOD

TECHNICAL FIELD

The present invention relates generally to devices for placing lines into spaces which are normally difficult to reach. More particularly, the present invention relates to a device for placing pull lines into areas which are normally difficult to reach and for connecting pull lines through travellers to working lines which are thereafter pulled into the spaces, and to the traveller which guides the connected pull and work lines over obstructions to reduce snagging.

BACKGROUND OF THE INVENTION

Strong, elongate work lines, such as ropes, cords, and the like, are commonly used for work purposes in a wide range of applications in various industries and work environments, including tree service industry, rigging, and rescue. Work ropes are often used in the tree service industry for moving tree servicers into areas of trees, for moving saws and tools into upper portions of trees, and for holding branches being removed from trees. Riggers use ropes to pass tools and equipment from one location to another. Search and rescue operations use ropes to pull persons to safety, for example, from a car in a flooded stream. These are but a few examples of situations requiring the use of work ropes, and further illustrate the need to place work ropes in to difficult-to-reach spaces.

The tree service industry particularly requires the placing of lines into remote areas of trees that are difficult-to-reach. The problems faced by persons in this industry for placing lines into remote areas have similarities with the placing of lines into difficult-to-reach spaces in other industrial applications. Generally, the tree service industry provides maintenance and control services of trees, including pruning of branches, removal of nuisance and dead branches, and removal of trees. Often this work requires workers to be located in the upper portions of trees in order to reach the branches to be cut away. For safety and handling purposes, work ropes (referred to herein as lines), are secured to the tree. Workers connect to the lines through repelling devices known as carabineer. The workers thereby are suspended and can swing from one part of the tree to another or move vertically on the line to reach other parts of the tree. Lines secured to the upper portions of trees also are used to support branches cut from the tree. These lines permit the cut branches to be lowered in a controlled manner to the ground.

Gaining access to upper portions of trees for the purpose of securing lines for tree workers and supporting branches is difficult and dangerous work. Typically, a tree climber free-climbs the trunk and branches to the upper portion of the tree. By this is meant that the tree climber is not secured with a safety line to hold the tree climber in the event of a fall. Such work is dangerous. The tree climber typically carries at least the end of a rope that feeds from a coil on the ground. The tree climber secures an end portion thereof to the upper portion of the tree. The tree climber and other workers may then repel to and from the tree on the line for placing other lines as necessary and for performing work on the tree.

Once a climber has reached an upper portion of a tree, other lines can be pulled into the tree for use in reaching other parts of the tree, for pulling equipment such as saws into the tree, and for restraining branches being cut from the tree. The ends of the lines are knotted together, or a line to be pulled is knotted at its end to an intermediate portion of a line already in the tree. The second line is then pulled into the tree by the climber pulling on the first line. However, the knots sometimes snag and catch on branches in the tree. Efforts to release the line caught by the branches include loopingly tossing the line outwardly from the branches, pulling the line back to the ground, or by the climber moving through the tree to the snag and releasing it. These efforts are not only time-consuming, but incur some risk of injury as the climber works to release the line.

While ladders may be used to provide initial access into trees, ladders are also dangerous to use due to balance and positioning problems. Ladders also have a limited height. Once the work in the tree is completed, the various lines in the tree must be unsecured from the tree, and the tree climber then repels from the tree to reach the ground.

In other work, ropes are useful tools. During search and rescue operations, rescuers may need to place a rope into a place which is difficult-to-reach, such as into a car in a swollen stream. Also, it may be difficult to throw a line or rope to a boat disabled in rough waters. Riggers may place ropes between buildings to pass tools and materials between work sites. While ropes provide useful tools, the placing of the ropes into these positions for use is often difficult, time-consuming, and impractical.

A device for placing lines into trees was evaluated. It was found that structural features of the device caused the device to experience problems with the reliability of operation in placing lines into remote areas of tall trees. Consequently, repeat efforts were required in order to successfully place a pull line into a tree. Specifically, the device has a slingshot mounted to a tubular handle of a conventional fishing rod to which a spool of fishing line is attached. A significantly elongate pole extended longitudinally from the handle to which the slingshot was mounted. The pole extended to a distal end remote from the spool and terminated in a loop through which the fishing line extended. A weight is connected to the free end of the fishing line. The weight was fired by the slingshot towards the difficult-to-reach area of a tree. In this device however the fishing line would frequently become enwrapped and entangled at the distal end portion of the elongated pole during the initial flight of the line as induced by the slingshot, and thus, repeat firings of the weight and line were required to position a line into the difficult-to-reach area. Once the fishing line was positioned into the remote upper portions of trees, the problem then become placing the work line into the tree. Knots connecting the fishing line and the work line often became caught on branches in the upper portion of the trees. Dislodging the knot was difficult from the ground. This would necessarily delay the tree service work and sometimes required free climbing the tree to dislodge the knot.

Accordingly, there remains a need in the art for an improved apparatus for placing work lines into spaces which are normally difficult-to-reach for the purpose of placing work lines. It is to the provision of such that the present invention is directed.

SUMMARY OF THE PRESENT INVENTION

The present invention solves the need in the art by providing an improved line placing device for placing work lines into remote, difficult-to-reach spaces. The device comprises a hand-gripped slingshot attached to a handle with a spool of a thin pull line, such as a fishing line, attached to the handle. The spool is selectively positioned for freely releasing the pull line from the spool and for retrieving the pull line onto the spool. The handle has a locally terminated distal end with an eye at the distal end local to the spool, and the pull line passes therethrough, with a weight attached to a distal end of the line. The weight is fired by the slingshot towards the difficult-to-reach area and thereby carries the pull line to the area. A work line, being attached to the pull line, is thereafter pulled to the difficult-to-reach area.

In one aspect of the invention, a conical traveller having a tapered end and a wide end encloses the engagement of the pull line and the work line for guiding travel of the work line to the difficult-to-reach spaces. More particularly, the traveller has a first coupler positioned at the tapered end for engaging a distal end of the pull line, and a second coupler positioned at the wide end of the traveller for engaging a distal end of a work line. In an application for the tree service industry, the pull line, being fired by the slingshot into and through an upper portion of the tree falls by the weight to the ground. The free end of the pull line is connected to the first coupler of the traveller which is also connected at the second coupler to the work line. The pull line is then rewound onto the spool, thereby pulling the work line from the ground, through the upper portion of the tree, and back to the ground. The conical traveller guides the connected pull line and the work line across branches in the upper portion of the tree with reduced snagging.

In another aspect, the present invention provides a traveller for connecting a pull line, extending from a supply to a place where it is normally difficult to place lines, to a work line, for placing the work line at the place. For example, the present invention provides a traveller for connecting a pull line (preferably a fishing line), extending from a supply through an upper portion of a tree and back to a position near the supply, to a work line for pulling the work line through the upper portion of a tree and back to near the supply. The traveller comprises a first conical elongate housing with a longitudinal axis and having a narrowed end and a wide end. An elongate wire extends along the longitudinal axis of the first conical housing and defines at one end a small loop that extends outwardly from the narrowed end of the first conical housing. The wire also defines a larger loop which extends outwardly of a second conical elongate housing that is slidably received on the elongate wire intermediate the first loop and the second loop. The second conical housing is selectively movable along the elongate wire between a first position slidably received within the first conical housing for exposing the second loop outwardly of the second conical housing and a second position for enclosing the second loop within the wide end portion of the second conical housing. A work line, being connected to the second loop when the second conical housing is in the first position and being enclosed within the second conical housing when the second conical housing is in the second position, is thereby shielded by the conical housing from being caught or snagged by branches in a tree as the pull line is rewound into the supply and thereby pulling the work line into the upper portions of the tree for placing the line therein.

In another aspect, the present invention provides a traveller for connecting a pull line, extending from a supply through an upper portion of a tree and back to a position near the supply, to an end of a work line for pulling the work line through the upper portion of a tree and back to near the supply. The traveller includes a single substantially conical housing having a narrow end and a wide end. A first engaging member extends from the narrow end for being connected to a free end of a pull line which extends from a rewindable supply through an upper portion of a tree. A second engaging member extends from the wider end of the conical housing for being connected to a free end of a work line, for being pulled through the upper portion of the tree upon return pulling of the pull line back to the supply.

The present invention provides a method of placing a work line into remote, difficult-to-reach spaces; for example, an upper portion of a tree, for use by a tree climber in performing tree maintenance services, by firing a projectile having a pull line attached thereto into an upper portion of a tree, whereby the pull line loops through the upper portion and extends downwardly to a lower portion of the tree. A traveller connects a free end of the pull line and a work line. The pull line is retrieved by pulling the pull line back through the upper portion of the tree, thereby pulling the work line upwardly through the upper portion of the tree and then downwardly. The traveller guides the passage of the connected pull and work lines through the tree so that the connection thereof does not catch on portions of the tree, whereby a work line is placed in the upper portion of the tree for use by a tree climber for performing tree maintenance services.

Objects, features and advantages of the present invention will become apparent upon reading the following detailed description of the disclosed embodiment of the present invention, in conjunction with the appended drawings and claims.

DETAILED DESCRIPTION OF THE PREFERRED EMBODIMENTS

Figure 1:
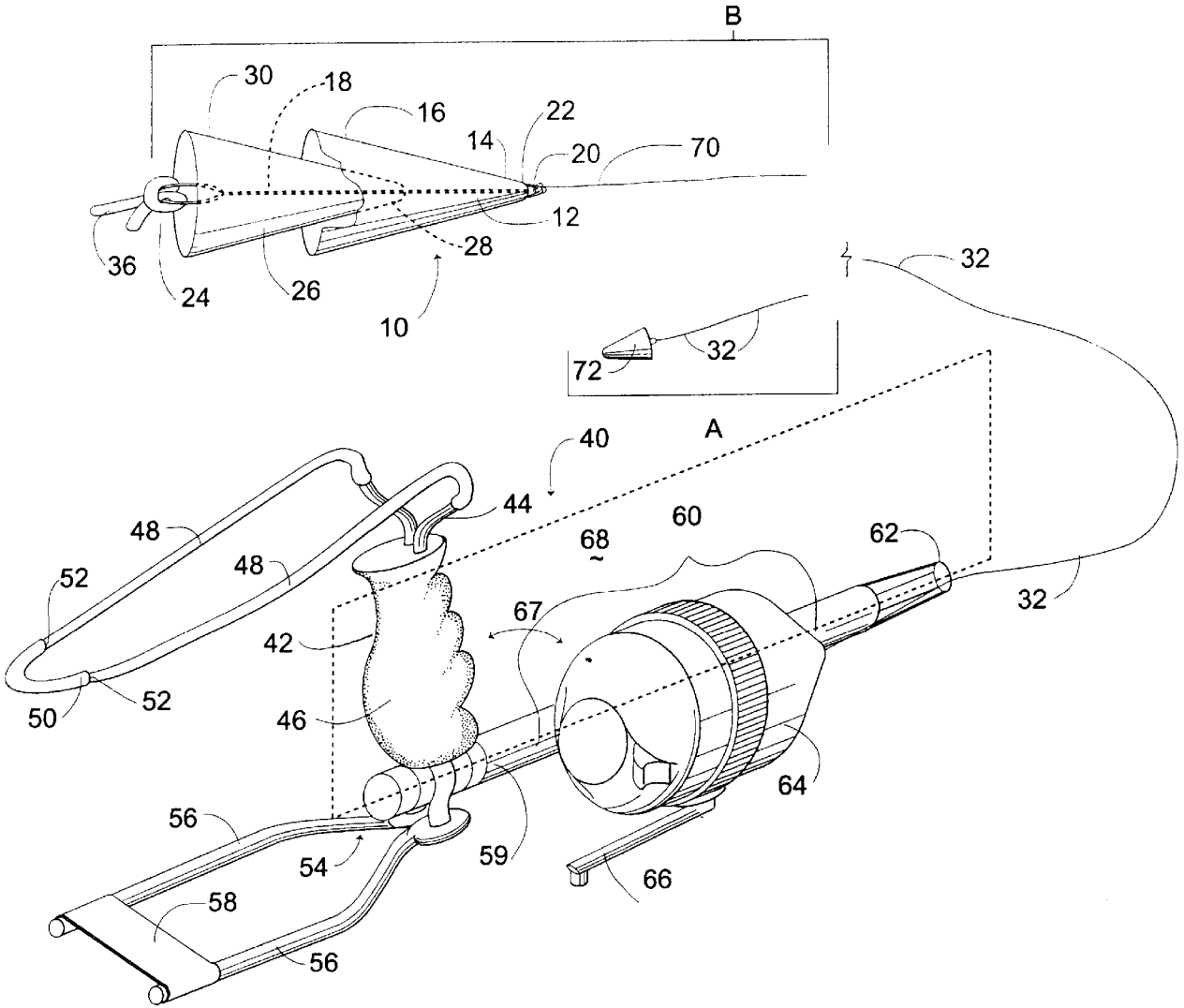
FIG. 1 is a perspective view of a line placing device made in accordance with the present invention.

Referring now in more detail to the drawings in which like parts have like identifiers, FIG. 1 is a perspective view of an embodiment of a traveler 10 made in accordance with the present invention for connecting a work line to be pulled by an attached pull line, for example through an upper portion of a tree. Preferably the pull line is a light weight, narrow diameter line such as fishing line. The traveller 10 comprises a first conical elongate housing 12 having a narrowed end 14 and a wide end 16. An elongate wire 18 extends along a longitudinal axis of the first conical housing 12. The wire 18 defines a small loop 20 that extends outwardly from a forward tip 22 at the narrowed end 14 of the housing 12, for a purpose discussed below. The wire 18 further defines a large loop 24 at a second end. A second conical elongate housing 26 having a narrowed end 28 and an wide end 30 is slidably received on the wire 18 intermediate the first loop 20 and the second loop 24. The second conical housing 26 is selectively movable along the elongate wire 18 between a first position slidably received within the first conical housing 12 and thereby exposing the second loop 24 (as illustrated in FIG. 1) outwardly of the second conical housing and a second position for enclosing the second loop 24 within the wide end portion of the second conical housing. The small loop 20 connects to a pull line 32 and the large loop 24 connects to a work line 36, for placing the work line into an remote difficult-to-reach space; for example, into an upper portion of a tree, as discussed below. In a preferred embodiment, the pull line is a fishing line supplied from a spool, as discussed below.

FIG. 1 illustrates an embodiment of a line-placing device 40 for placing the pull line 32 into an upper portion of a tree, as discussed below. The traveller 10 is used with a line-placing device 40 which generally comprises a projectile delivery and retrieval apparatus. As illustrated in FIG. 1, and generally designated "A", the pull line 32 is first attached to the projectile (typically a weight 72) which is fired into the upper portions of a tree and subsequently retrieved. The weight 72 is removed and the work line 36 connected through the traveller 10 to the pull line 32, as also illustrated in FIG. 1 and generally designated "B". The line-placing device 40 comprises a slingshot frame 42 having a pair of arms 44 extending from a hand grip 46. An elastic band 48 attaches to each of the arms 44. A pocket 50 connects to the distal ends 52 of the bands 48.

In the illustrated embodiment, an arm brace 54 extends laterally from the hand grip 46. The arm brace 54 comprises two parallel members 56 which slidingly receive a pad 58 disposed between the members. The hand grip 46 connects to a butt-end portion 59 of a handle member 60 which extends from the hand grip 46 longitudinally in a direction opposite of the arm brace 54 and terminates in a local distal end. The member 60 includes at least one eyelet 62 at a distal end of the member. A conventional fishing reel 64 with a rewind handle 66 attaches to the handle portion of the member 60 and includes a spool of a supply of the pull line 32. As illustrated, the reel 64 for the pull line 32 is disposed laterally of the handle member 60 at an oblique angle 67 relative to a plane 68 defined a longitudinal axis of the handle member and a center line of the slingshot handle 46. A free end 70 of the line 32 extends through the eyelet 62, which is distally local to the spool. A weight is selectively attachable to the free end 70 of the line 32. As discussed below, the free end 70 is also selectively connected to the small loop 20 of the traveller 10 for communicating the work line 36 into a difficult-to-reach space, such as into and through an upper portion of a tree.

Figure 2:
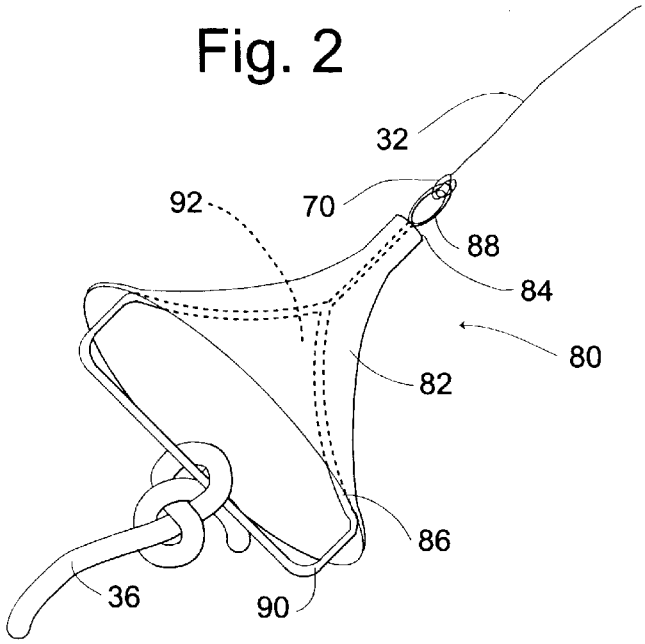
FIG. 2 is a perspective view of an alternate embodiment of a line placing device in accordance with the present invention.

FIG. 2 illustrates a perspective view of an alternate embodiment 80 of the traveller 10. In this alternate embodiment, the traveller 80 comprises a single conical housing 82 having a narrow end 84 and a wide end 86. A first engaging member 88 extends outwardly at the narrow end 84 for being connected to the free end 70 of the pull line 32 which extends from the rewindable spool of the fishing reel 64. A second engaging member 90 extends outwardly at the wider end 86 of the conical housing 82 for being connected to the free end of the work line 36. In the illustrated embodiment, the first engaging member 84 and the second engaging member 90 are defined by loops formed in a metal wire 92 which is disposed within the traveller 80. The metal wire 92 is secured within the housing 82 by a solidified media, such as an adhesive, epoxy, crimping device, or the like.

Figure 4:
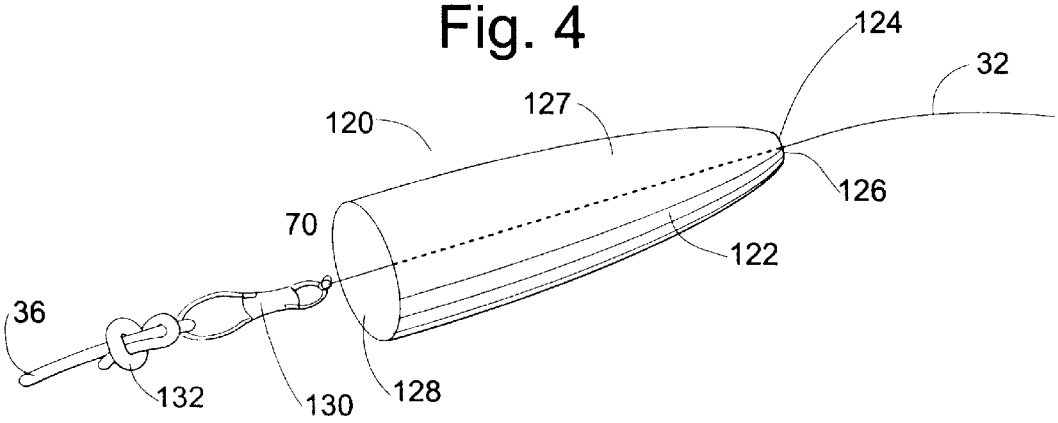
FIG. 4 is a perspective view of an alternate embodiment of a traveller useful with the line placing device of the present invention.

FIG. 4 illustrates a perspective view of a second alternate embodiment 120 of the traveller 10. In this alternate embodiment, the traveller 120 comprises a single elongate, conical housing 122 having a narrow end 124 that defines an opening 126 therein and a wide end 127 defining an opening 128. The free end 70 of the pull line 32 extends through the opening 126, the interior of the housing 122, and through the opening 128. The free end 70 connects to a clip 130 or other coupler device, such as a snap clip used commonly with fishing lines for connecting weights, lures, and bobbers. The work line 36 engages the clip 130 by being tied with knot 132 thereto. After the work line 36 is secured to the pull line 32, the engagement thereof is covered by sliding the housing 122 longitudinally over the engagement, whereby the pull line 32 and the work line 36 are connected together and the engagement thereof are enclosed by the traveller which guides the travel of the engaged lines over obstacles, such as branches in trees, for placing the work line into a difficult-to-reach place in a tree.

The elongated housings 12, 26, 120 of embodiments of the traveller 10 can be manufactured by molding with a plastic material. The traveller 10 is assembled by inserting the wire 18 through the narrow end 14 and securing the small loop 20 thereto. The second housing 36 is slidingly received on the wire 18, and the larger loop 24 formed in the wire. The alternate embodiment of the traveller 80 likewise is formed in a mold with a plastic material. Embodiments can be made wherein the wider end 86 has diameter sufficient to accommodate lines of different diameters. For example, a series of embodiments of the traveller 80 can be made wherein the wider end of the travellers in the series have incrementally larger diameters; i.e., of ½ inch, ⅝ inch, ¾ inch, and so forth.

Figure 3:
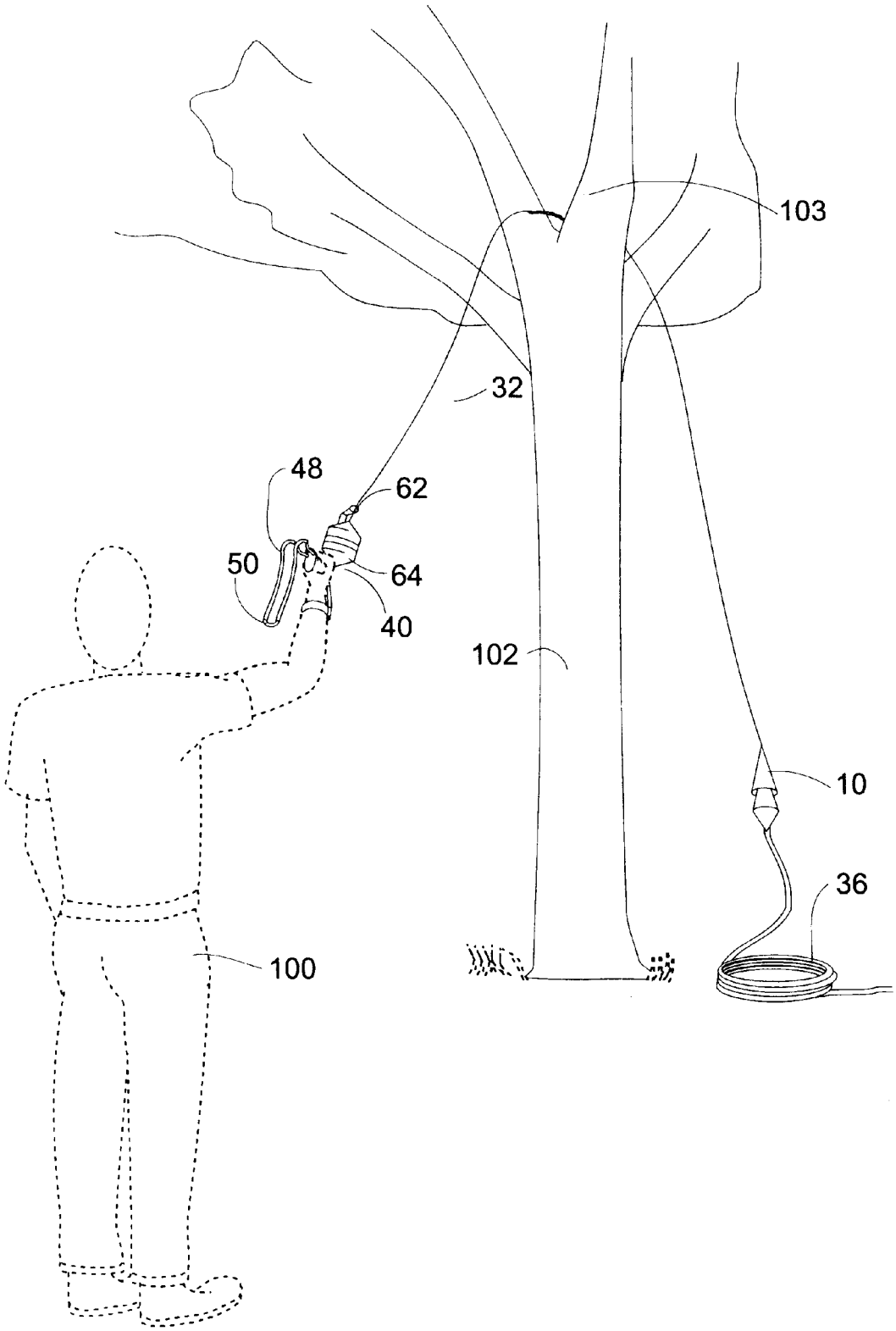
FIG. 3 is a perspective view of the line placing device shown in FIG. 1 being used for placing a line in a tree.

With reference to FIG. 3, the travellers of the present invention are operated to connect the pull line 32 with the work line 36 and to guide the movement of the work line, 36 into and through the upper portions of a tree 102, for placing the work line therein. A tree climber 100 stands near a tree 102 for which tree work is to be done in an upper portion 103. The tree climber 100 holds the line placing device 40 by inserting one hand and a portion of his arm between the members 56 and gripping the hand grip 46. The pad 58 covers the forearm of the tree climber 100 to cushion and support the slingshot line placing device 40.

A weight (not illustrated) such as a fishing line weight is attached to the free end 70 of the pull line 32. The weight defines a projectile which is fired by the slingshot into the upper portions of the tree. This is accomplished by placing the weight within the pocket 50. The tension on the spool of line in the fishing reel 64 is released. The pocket 50 with the weight is grasped with the free hand of the tree climber 100. The pocket 50 is pulled rearwardly, thereby stretching the elastic bands 48 relative the grip 46. The climber 100 aims the line placing device towards the upper portion 103 of the tree 102. The pocket 50 is suddenly released, and the elastic bands 48 pull the pocket 50 forwardly rapidly. The weight attached to the free end 70 of the line 32 is propelled forwardly from the line-placing device 40 towards the upper portion 103 of the tree 102. The weight carries the pull line, freely unwinding from the spool 64, through the locally disposed eyelet 62, and through the upper portions 103 of the tree 102. The weight causes the pull line 32 to move downwardly to the ground. An alternate embodiment of the line-placing device uses compressed gas to fire the weight as a projectile from the device into the upper portions of the tree. In this embodiment (not illustrated), a gun-like apparatus includes the reel 64 with the spool of fishing line. The projectile weight pulls the fishing line from the spool into the tree. In yet another alternate embodiment, the line-placing device includes an explosive-fired projectile to which the pull line is secured for delivering the pull line to places normally difficult-to-reach with a rope.

The tree-climber 100 then detaches the weight from the free end 70 of the pull line 32. The traveller 10 of the present invention is then attached to the pull line 32 by connecting the free end 70 to the loop 20. The pull line 32 may be tied to the loop 20 or attached with a connecter (not illustrated). The work line 36 is then attached to the traveller 10. First, the second housing 26 is moved to the forward position relative to the first housing 12, whereby the loop 24 is exposed outwardly of the second housing. The work line 36 is tied to the loop 24. The second housing 26 is then moved to the rearward position relative the first housing 12, whereby the loop 24 is enclosingly received within the second housing. The second housing 26, while in the second position, is at least partially received within the first housing 12. The second housing 26 accordingly defines a smooth, tapered exterior for the knotted connection between the traveller 10 and the work line 36.

The climber 100 then rotates the handle 66 of the fishing reel 64 in order to rewind the pull line 32 on to the spool of line within the fishing reel. This causes the traveller 10 to move upwardly towards the upper portion 103 of the tree 102. The traveller 10 guides the connection between the pull line 32 and the work line 36 over branches of the tree. The tapered exterior surface of the traveller defines a narrowed portion which first contacts branches of the tree 102. The tapered exterior of the traveller 10 facilitates passage of the traveller across the branches of the tree 102 in order to reduce snags. The climber 100 continues to rewind the pull line 32 into the spool until the traveller 10 moves downwardly out of the tree to the ground near the climber. This pulls the work line 36 through the upper portion 103 of the tree 102. Once the traveller 10 is grounded, the traveller is disconnected from the work line 36. The work line 36 is then used by the climber for gaining access to the upper portion 103 of the tree for performing tree service work.

The present invention accordingly provides a device 40 for placing work lines 36 into difficult-to-reach spaces and a traveller 10 in various embodiments for connecting the pull line 32 to the work line 36 for placing the work line into difficult-to-reach spaces; for example as discussed herein, into the upper portions of trees for tree service work, wherein the placing device 40 fires a projectile or weight 72 with the pull line 32 attached thereto into the tree. The weight 72 thereafter falls to the ground and thereby pulls the pull line down to the ground. The traveller 10 connects the pull line 32 and the work line 36 together. The tapered exterior of the traveller 10 shields the engaged connection of the work line 36 to the pull line 32 through the traveller. The traveller guides passage of the work line through the tree as the pull line 32 is rewound into the supply spool and thereby pulling the work line 36 through the upper portions of the tree for placing the work line therein.

It is to be appreciated from the disclosure herein of the preferred embodiments of a device for placing lines into places which are difficult normally to reach with a line with reduced entangling of the line on a distally remote end of the device and that the present invention is gainfully employed in industries and applications other than tree service. For example, the line placing device of the present invention is gainfully used in rescue operations, rigging activities, and the like. For example, the line placing device accurately places the weight with the pull line to a car in a swollen stream. The traveller is readily connected to an intermediate portion of the pull line. The persons to be rescued thereafter pull the work line, connected to the pull line by the traveller, to themselves. It is noted that for visual assistance, the weight 72 and the pull line 32 can be phosphorescent. Similarly, the device and traveller are gainfully used by riggers for positioning a rope or work line to a remote place for transfer of tools and equipment. Accordingly, the present invention is readily used in a range of industries and applications in which ropes (or lines) function as useful tools.

The principles, preferred embodiments and modes of operation of the present invention have been described in the foregoing specification. The invention is not to be construed as limited to the particular forms disclosed because these are regarded as illustrative, rather than restrictive. Moreover, variations and changes may be made by those skilled in the art without departing from the spirit of the invention as described by the following claims.

What is claimed is:

1. A device for placing a work line into a space that is normally difficult-to-reach, comprising:

a hand-gripped slingshot having a hand grip and a pair of arms extending therefrom that engage elastic bands which attach to a pocket for receiving a weight to be fired from the slingshot;

a tubular handle having a locally terminated distal end with an eyeloop fixed thereto, the slingshot attached at a lower end of the hand grip to an opposing butt end of the handle, and the eyelet disposed outwardly of a travel path for the weight fired from the slingshot;

a spool of a pull line attached to the handle vertically spaced from the arms of the slingshot and disposed laterally of the tubular handle at an oblique angle relative to a plane defined by a longitudinal axis of the tubular handle and a center portion of the slingshot handle, whereby the spool is disposed remote from the travel path of the weight, said spool selectively operated for freely releasing said pull line from said spool and for rewinding said pull line onto said spool, and a free end of the pull line extending through said eyeloop; and a weight attached to said free end of the pull line; and a traveler comprising at least a conical open-ended tube that defines a leading end that is narrower in diameter than a trailing end, for enclosing an engagement of said pull line and a work line; and an elongate member extending through the traveler and defining at one end a first connector outwardly of the leading end for engaging the pull line and a second connector at an opposing end of the member for engaging the work line, the first connector and the second connector being unitary with the elongate member, whereby the weight, being directed along the travel path into flight into a difficult-to-reach space, moves said pull line thereinto, and the work line, being engaged to the second connector, is thereafter pulled into the difficult-to-reach space by pulling on the pull line.

2. The device as recited in claim 1, further comprising a brace defined by a pair of laterally extending members from a lower end of the handgrip and a fabric sheet connected between the members near respective distal ends thereof, whereby the sheet bears against a user's forearm to brace the firing of the weight during operation of the device.

3. The device as recited in claim 1, wherein the elongate member comprises a wire and wherein the first and second connecters each comprise a loop formed in the wire at respective opposing ends.

4. A traveler for connecting a pull line, extending from a supply through an upper portion of a tree and back to a position near the supply, to a work line for pulling the work line through the upper portion of a tree and back to near the supply, comprising:

a first conical elongate housing with a longitudinal axis and having a narrowed end and a wide end;

an elongate wire extending along the longitudinal axis of the first conical housing and defining at one end a small loop that extends outwardly from the narrowed end of the first conical housing and a larger loop at another end of the wire, the small loop for engaging a pull flexible line from a rewindable supply after the pull line is communicated through an upper portion of a tree;

a second conical elongate housing having a narrowed end and an wide end slidably received on the elongate wire intermediate the first loop and the second loop, the second conical housing being selectively movable along the elongate wire between a first position slidably received within the first conical housing for exposing the second loop outwardly of the second conical housing and a second position for enclosing the second loop within the wide end portion of the second conical housing, and while in second position, the second housing at least partially received within the first housing, whereby a work line, being connected to the second loop when the second conical housing is in the first position and the connection of the workline to the second loop being enclosed within the second conical housing when the second conical housing is in the second position, is thereby shielded by the conical housing from being caught by branches in a tree as the pull line is rewound into the supply and thereby pulling the work line into the upper portions of the tree for placing the line therein.

5. A device for placing a work line into a space that is normally difficult-to-reach, comprising:

a hand-gripped slingshot having a hand grip and a pair of arms extending therefrom that engage elastic bands which attach to a pocket for receiving a weight to be fired from the slingshot;

a tubular handle having a locally terminated distal end with an eyeloop fixed thereto, the slingshot attached at a lower end of the hand grip to an opposing butt end of the handle, and the eyelet disposed outwardly of a travel path for the weight fired from the slingshot;

a spool of a pull line attached to the handle vertically spaced from the arms of the slingshot and disposed laterally of the tubular handle at an oblique angle relative to a plane defined by a longitudinal axis of the tubular handle and a center portion of the slingshot handle, whereby the spool is disposed remote from the travel path of the weight, said spool selectively operated for freely releasing said pull line from said spool and for rewinding said pull line onto said spool, and a free end of the pull line extending through said eyeloop; and a weight attached to said free end of the pull line;

a traveler comprising a first and a second conical open-ended tube that each define a leading end that is narrower in diameter than a trailing end, for enclosing an engagement of said pull line and a work line; and an elongate member extending through the traveler and defining at one end a first connector for engaging the pull line and a second connector at an opposing end for engaging the work line, the second tube being selectively movable along the member within the first tube between a first position for attaching the work line to the second connector and a second position extended outwardly therefrom for enclosing the connection of the work line to the second connector, whereby the weight, being directed along the travel path into flight into a difficult-to-reach space, moves said pull line thereinto, and the work line, being engaged to the second connector and enclosed within said traveler, is thereafter pulled into the difficult-to-reach space by pulling on the pull line.

6. The device as recited in claim 5, wherein the elongate member comprises a wire and wherein the first and second connecters each comprise a loop formed in the wire at respective opposing ends.

* * * * *